United States Patent [19]

Lindahl

[11] 4,228,847

[45] Oct. 21, 1980

[54] CORE FOR USE IN HUMIDITY EXCHANGERS AND HEAT EXCHANGERS AND METHOD OF MAKING THE SAME

[75] Inventor: Sven Lindahl, Spanga, Sweden

[73] Assignee: Aktiebolaget Care Munters, Sollentuna, Sweden

[21] Appl. No.: 11,880

[22] Filed: Feb. 13, 1979

[30] Foreign Application Priority Data

Feb. 16, 1978 [SE] Sweden ..... 7801820

[51] Int. Cl.[3] ..... F28D 19/00

[52] U.S. Cl. ..... 165/10; 55/390; 29/157.3 R; 156/187; 156/200; 156/205

[58] Field of Search ..... 165/10; 55/390; 29/157.3 R

[56] References Cited

U.S. PATENT DOCUMENTS

| | | | |
|---|---|---|---|
| 2,795,400 | 6/1957 | Stark | 165/10 X |
| 2,983,486 | 5/1961 | Rosenberg | 165/10 X |
| 3,186,479 | 6/1965 | Mondt | 165/10 |
| 3,756,310 | 9/1973 | Becker | 165/10 X |
| 4,136,729 | 1/1979 | Sabaki | 165/10 X |

*Primary Examiner*—Albert W. Davis

[57] ABSTRACT

A core usable as a rotor in humidity exchangers and heat exchangers is disclosed.The core is comprised of alternate layers of flat and corrugated sheet material so arranged that the corrugations form with the flat layers a plurality of fine channels running substantially parallel to each other and axially to the center of the core. The corrugated layers in the axial direction extend at least at one end face of the core beyond the flat layers and the extending corrugated edges are reinforced. A method and apparatus for forming the core is also disclosed.

6 Claims, 2 Drawing Figures

CORE FOR USE IN HUMIDITY EXCHANGERS AND HEAT EXCHANGERS AND METHOD OF MAKING THE SAME

The present invention concerns a rotor or similar core for use in humidity exchangers and/or heat exchangers, comprising a mass or core for the exchange of humidity and/or heat built up of alternate flat and corrugated layers so arranged that the corrugations form a large number of fine channels running essentially parallel to one another and to the rotor shaft between two end faces of the rotor. The invention is also concerned with a method for manufacturing a rotor of this nature.

Rotors of the type described above are normally manufactured by assembling and uniting, usually by gluing, alternate flat and currugated layers, the structure so obtained, consisting of one flat and one corrugated layer, being thereafter wound or coiled to form a rotor or similar core of essentially cylindrical form in which the coils are also mutually united by the method described. The material used for the layers forming the rotor is usually a metal, e.g. aluminum, or plastics. In order to keep the weight of the rotor assembly as low as possible, as well as to cut the cost of manufacture and to achieve a considerably improved performance of the layers, it is desirable to use as thin a material as possible for manufacture, foil for instance. If, for example, the layers are of aluminium, their thickness is often less than 100 μm.

However, the use of thin material in manufacturing rotors brings about certain problems. During winding, before the layers are stabilised in the rotor assembly, difficulties are encountered in handling the thin foil without damaging it; and since the layers have a tendency to slip during winding,making it difficult to obtain smooth end faces on the ends of the rotor, they must be guided into place during this operation and the edges of the thin foil can easily be damaged. Even in the finished rotor the end faces are sensitive to pressure, point loads on the end faces being particularly likely to damage the exposed edges of the foil, nor is it always possible to obtain smooth end faces by machining—this is the case for some metals, particularly aluminium, and also plastics. Uneven end faces in the rotor assembly, due to poor guiding during the winding operation, can therefore not be remedied once the assembly is finished.

The chief objective of the invention is to achieve a rotor in which the difficulties and drawbacks described above have been eliminated. Another goal is to devise a method of manufacture of a rotor of this nature, this method producing a rotor structure with smooth surfaces and having greater resistance to damage on the end faces than rotors of this type known hitherto.

These objectives and goals are achieved in that the rotor, and the method of its manufacture, are provided with the characteristics set out in the claims to follow.

The invention and its characteristic features and advantages will be described in greater detail in the following paragraphs with reference to the drawings and the embodiment shown therein by way of example.

Figure 1:
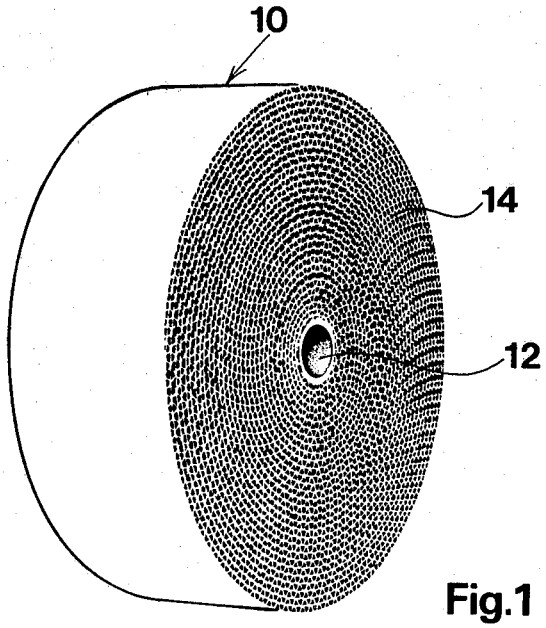
FIG. 1 shows a perspective view of a rotor built to embody the invention.

The rotor 10 shown in FIG. 1 takes the form of a cylinder having a hub 12 through which a supporting shaft can pass to hold the rotor in a frame. Between the hub 12 and the outer circumference, the rotor 10 is filled with a mass of heat or humidity exchanging material built up of thin layers of e.g. a metal such as aluminium or the like, plastics, or other material whose properties are suitable for this application. If the rotor is to be used for the transfer of humidity, the layer will also be impregnated or coated with some hygroscopic substance such as lithium chloride, aluminium hydroxide or other solid absorbent/adsorbent.

Figure 2:
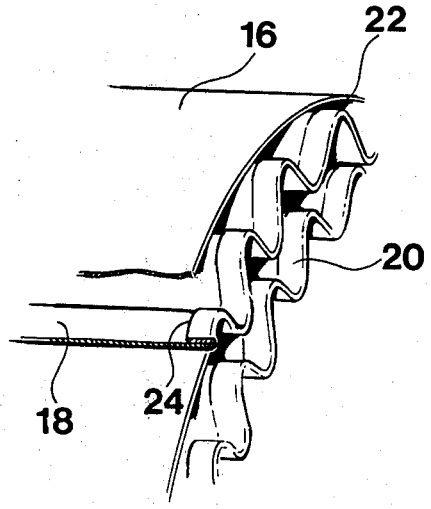
FIG. 2 shows a detail of an end face of the rotor shown in FIG. 1, also in perspective but on a larger scale.

As is apparent in the detail of FIG. 2, the heat-exchanging mass 14 consists of alternate flat 16 and corrugated 18 bands helically wound to form the cylindrical body of the rotor. When wound, the corrugations run in an axial direction and so form a large number of fine through channels. The distance between the flat surfaces in adjacent turns should preferably be less than 5 mm, e.g. 1 to 3 mm, and this will therefore be the corrugation height of the corrugated layers lying between them. The rotor may, for instance, be constructed by first bringing together and uniting, e.g. by gluing, one flat and one corrugated layer and then winding this composite layer to form the cylindrical body of the rotor, the turns here also being united by e.g. gluing. A more detailed description of the rotor construction may be found in West German Pat. 2,722,102 published Dec. 1, 1977.

In order to keep the weight of the completed rotor 10 down and to keep manufacturing costs low while still giving as low a pressure drop as possible in the medium passing through the rotor, it is desirable that it be possible to use the thinnest possible foil in building up the layers 16, 18. When aluminium is used the layers are thus normally extremely thin, being no thicker than e.g. 100 μm, say 35–50 μm or less. However, layers of material as thin as this are difficult to handle during fabrication; they are, for instance, hard to guide during the winding operation, and efficient guidance is to be desired since the layers otherwise slip relative to each other and give rise to irregularities on the end faces of the rotor assembly 10. If, however, the thin foil is in fact guided into position, the edges very easily get damaged. Again, the assembled rotor is sensitive to pressure during transport and storage since the edges of the thin foils are easily bent, especially by point pressure. In accordance with the invention the corrugated layers project beyond the flat layers 16, and, moreover, the edges thereof are provided with a reinforcement 20 giving stability to the corrugated layer 18 and making the edge less sensitive to external pressure. This reinforcement 20 should preferably be formed, as shown in FIG. 2, in that a part of the edge of the corrugated layer 18 is folded back, a process which should preferably be carried out before corrugation and joining to the flat layer 16. A further feature of the invention is that the flat layer 16 has a breadth relative to the corrugated layer 18 such that the edge 22 of the flat layer 16 lies within the inner edge 24 of the reinforcement 20.

A rotor embodying the invention will provide a number of advantages in fabrication and handling. Since the corrugated layer 18 is provided with reinforcement 20 along its edge, it can be guided during the winding operation by a guiding means acting on the edge of the foil, since this latter has now been given far greater stability and strength through the presence of the reinforcement 20. Since both edges of the corrugated layer 18 are reinforced and the breadth of the flat layer 16 is equal to or less than the breadth of the corrugated layer 18 minus that of the reinforcements along the edges, the flat layer 16, too, can be effectively guided, tending as it does to be guided down and positioned naturally in the recess or pocket between the reinforcements 20 and thus to bear upon essentially the entire width of the ridges of the corrugated layer 18. Since the reinforcement 20 of the edges is achieved by folding, tolerances in the breadth of the input material, as foil, are no longer of crucial importance because the layers 18, and hence the rotor as a whole, can be given the desired width to within extremely close margins of tolerance by the folding operation itself. Owing to the fact that the reinforced, corrugated layer 18 projects beyond the flat layer 16 in the finished rotor assembly 10, the end faces are considerably less susceptible to damage by e.g. pressure from outside sources, meaning less surface damage during transport and storage off the rotor. The flat layer, which is the most liable to damage of the layers, lies well back inside the protective zone formed by the outer part of the corrugated foil. Thanks to its undulating surface, the corrugated foil is in itself more resistant to damage than the flat layer, and folding the corrugated layer has a far greater effect than would folding the flat layer.

By limiting folding to the portion projecting beyond the edge of the flat layer, the combined thickness of the flat and the corrugated foils at the points of contact will be equal across the whole breadth of the rotor, that is it will be equal to the sum of the thickness of both layers of foil. If the edge were to be folded further back, the combined thickness at the points of contact furthest out, just inside the rotor, would be that of three layers of foil, which might result in the possible deformation of the rotor and a reduction in strength at the same time as the pressure drop across the rotor would increase. The reinforced edge of the corrugated layer 18, along with the accurately controlled breadth obtained as described above, also produces a rotor that causes less wear on the gaskets or seals usually fitted against its end faces when it is installed for use and which serve to divide it into sectors by methods already known. Reinforced, e.g. folded, edges 20 also add to the stability of the rotor as a whole, with the result that foil thinner than that used hitherto can be employed in the fabrication thereof. It should be emphasized that the thickness of the folded edges 20 is still so insignificant by comparison with the size of the channels that the characteristic transfer properties and/or the flow rate of the media through the rotor remain entirely unaffected or are changed only to a negligible degree.

Clearly, the embodiment illustrated here is only one example of possible ways of realizing the invention, and, if so desired, other embodiments are conceivable. Thus, the reinforcement along the edge 20 may be achieved by means other than folding, examples being by gluing a reinforcing strip along the edge, by applying some reinforcing material by dipping, by upsetting the edge, or by similar means, without departing from the original purposes of the invention.

I claim:

1. Rotor or similar core for use in humidity exchangers and/or heat exchangers, comprising a mass or core for the exchange of humidity and/or heat built up of alternate layers of flat and corrugated material so arranged that the corrugations form a large number of fine channels running essentially parallel to one another and to the rotor shaft between two end faces of the rotor, characterized in that the corrugated layers seen in a direction along the axis of the rotor project beyond the flat layers at one or both end faces and are provided with reinforced edge portions.

2. A core usable in humidity exchangers and heat exchangers comprising a laminate of alternate layers of flat and corrugated strip material, said layers cooperating to define a plurality of fine substantially parallel channels extending transversely through said laminate, said corrugated strip material being wider than said flat strip material and having reinforced edges and said flat strip material having a width no greater than the distance between the inner edges of the reinforced portions of the corrugated strip material.

3. A core usable as a rotor in humidity exchangers and heat exchangers comprising a helically wound laminate of alternate layers of flat and corrugated strip material, said layers cooperating to define a plurality of substantially parallel channels extending axially from side to side of said core, the corrugated strip at at least one side of said core extending laterally beyond the flat strip and having a reinforced edge portion.

4. A core according to claim 3 wherein the corrugated strip extends laterally beyond the flat strip at both sides thereof and both side edges of the corrugated strip are reinforced.

5. A core according to claim 3 and wherein the edge reinforcement of the corrugated strip material is a folded edge of said strip material.

6. A core according to claim 5 and wherein the flat strip material is narrower than the distance between the inner margins of the edge reinforcements of the corrugated strip.

* * * * *